US005743652A

United States Patent [19]

Dopps

[11] Patent Number: 5,743,652

[45] Date of Patent: Apr. 28, 1998

[54] RESEALABLE BAG

[76] Inventor: Daniel A. Dopps, 11415 Merridale, Wichita, Kans. 67212

[21] Appl. No.: 693,887

[22] Filed: Aug. 5, 1996

[51] Int. Cl.[6] ..... B65D 33/16

[52] U.S. Cl. ..... 383/89

[58] Field of Search ..... 383/89, 88, 90, 383/91; 24/30.5 R

[56] References Cited

U.S. PATENT DOCUMENTS

| | | | |
|---|---|---|---|
| 1,045,020 | 11/1912 | Guinzburg | 383/89 |
| 1,067,741 | 7/1913 | Jones | 24/30.5 T |
| 1,357,789 | 11/1920 | McHaffie | 383/89 |
| 1,729,152 | 9/1929 | Buxton | 383/89 |
| 1,743,509 | 1/1930 | Zauner | 383/91 |
| 1,748,529 | 2/1930 | Strayer | 383/91 |
| 3,066,846 | 12/1962 | Domigan | 383/89 |
| 3,259,302 | 7/1966 | Rocchisani | 383/95 |
| 3,299,927 | 1/1967 | Clarizio | 383/91 |
| 3,688,973 | 9/1972 | Lillkvist | 383/89 |
| 4,153,089 | 5/1979 | Veilleux | 383/89 |
| 4,789,248 | 12/1988 | Penas | 383/89 |
| 5,000,500 | 3/1991 | Almog | 383/89 |

FOREIGN PATENT DOCUMENTS

| | | | |
|---|---|---|---|
| 89978 | 6/1958 | Denmark | 383/89 |
| 10642 | 9/1908 | United Kingdom | 383/89 |

*Primary Examiner*—Stephen P. Garbe
*Attorney, Agent, or Firm*—Bradley P. Sylvester

[57] ABSTRACT

An improved resealable bag, typically used for snacks such as potato chips, cookies, and other types of chips. A set of snaps are fixed directly onto the bag, and are spaced along each side of the bag, closer to the top than the bottom, with the space between a snap and the top of the bag sufficient so that the top edge and a portion of the bag can be folded over, and then the top portion of the bag being rolled in the opposite direction until the snaps are again oriented similarly as they were prior to the rolling. The snaps are grasped, which causes the sides of the bag adjacent to the snaps to move inward, providing an open space through which the snaps are urged together and attached to each other, so that the rolled portion is formed into a U-shape. This causes the folded top edge and layers of the rolled portion to press together, so as to prevent any air from moving from the outside of the bag to the contents, or from the contents to outside the bag.

1 Claim, 2 Drawing Sheets

RESEALABLE BAG

BACKGROUND OF THE INVENTION

Plastic bags have a wide variety of uses, and are intended to contain and protect many different types of items. For example, food items such as chips, cookies, crackers, and cereal, are generally sold in disposable plastic bags. The plastic materials used in these bags, are resistant to bending, and tend to return to their original position and shape even after being bent or squeezed. Plastic bags, by virtue of being used for many different types of items may possess varying degrees of stiffness, thickness, and resilience. Generally, plastic bags are intended to be airtight, until opened by the consumer. In addition, the air in a sealed bag provides a protective cushion from external forces, that can crush the contents of the bag. This is especially true with potato chips and other similar products.

When dealing with bags used for food items, the fresh taste of the products can be preserved if the bag can be closed to maintain an airtight seal. The typical consumer method generally comprises folding or twisting the open end of the bag, and either placing some sort of clip to hold the folded portion in place, or simply hoping it will stay folded or twisted up. Either method is an imperfect choice, since the construction of these bags do not readily accept or retain folding and bending, and clips do not completely seal the bag. A bag that is closed by simply folding or twisting a portion of the bag, near the open mouth of the bag, will usually allow air to enter or exit the bag, since the layers that make up the rolled portion are unable to press tightly against each other. If external force is not used to hold the twisted and folded portions in place, the seal will not be maintained.

Numerous products and methods have been applied to bag open ends, or their mouth, attempting to recreate the airtight seal. It has been observed that folding up the portion of the bag that defines the open mouth of the bag, provides a measure of resealing to certain types of bags. Some of the advantages in folding over the open mouth flaps of a bag, for purposes of creating a stronger seal, are disclosed in U.S. Pat. No. 1,743,509 (Zauner). This patent was directed toward cloth type bags, and utilized a fastener, which fastened over the folded edges of the bag mouth opening. This fastener is cumbersome for use on bags other than cloth or canvas bags. Consumers would be unlikely to use this method on bags such as potato chip bags, since it would fail to maintain an airtight seal, unless the fastener pressed the bag edges together with a great deal of force.

A method and apparatus for sealing bag containers, such as water bottles, is disclosed in U.S. Pat. No. 3,299,927 (Clarizio). This patent has a primary use for containers that store liquids. Typically, these types of bottles are manufactured out of rubber or a soft elastic plastic. When the narrow mouth portion of the container was folded, a protruding strap secured the folded portion so that it did not unroll. This worked extremely well for these flexible rubber type containers, since the folded layers easily pressed together, creating an airtight and watertight seal. This method is inadequate to maintain an air tight seal on bags, such as potato chip bags or snack bags, because of the resilience of the material. Although a convoluted air passage would be created, making it difficult for air to enter or exit the bag, the layers of the rolled or folded portion would have difficulty flexing or stretching enough to press against other layers uniformly enough to create a stable air tight seal.

Another bag device is disclosed in U.S. Pat. No. 4,421,150 (Masters) in which the mouth portion of a bag was folded over, with a cover flap fastening over the folded portion, and secured to the sides of the bag. In this invention, the sealing capabilities of the folded portion are adequate, but do not translate very well to plastic bags, especially snack type bags such as a potato chip bag. In order for this sealing method to work properly in the bag disclosed in this patent, the bag must have a case or semi-rigid body to secure restraining straps to. These attributes are not present in the majority of plastic bags, such as a potato chip bag.

A further method of sealing a container, is described in U.S. Pat. No. 4,638,912 (Graf). In this invention, various flaps are folded several times and then secured against the rigid body of the container. The problems inherent with this sealing method, when applied to a snack-type bag, such as a potato chip bag, are that potato chip bags do not have a rigid body or sidewalls. In addition, the folding or rolling up of a potato chip bag will have difficulty in providing an air tight seal, due to the resistance of the bag material to deform tightly against an adjacent rough surface, such as the adjoining rolled layer.

Due to the fierce price competition in the marketplace for these products, as well as the need for a simple means to reseal bags, consumers must be able to use this invention without having to spend undue time learning how to use it, and that it work efficiently and simply. The means to reseal should be able to be incorporated into existing bag designs, simply and cheaply, or modified bags be produced. The resealing means should provide a strong airtight seal, that not only maintains product freshness, but also protects the contents from breakage, by sealing a pocket of air within the bag. While previous inventions have tried various methods to press folded portions against the bag body, none of these methods has the necessary simplicity, ease of use, or reliability necessary for bags such as common potato chip bags.

Foreign patents have also been issued, with regard to bag sealing methods. Patent 10,642, issued in the United Kingdom on Sep. 17, 1908, and disclosed a bag having a metal band, which was situated near the open flaps along the length of the bag. The open end flaps of the bag were rolled around the metal band, and then the ends of the metal band were connected together, keeping the rolled portion of the bag from unrolling. This invention required the use of flaps, rather than an attachment means directly on the bag itself.

Another patent was issued in the Commonwealth of Australia in 1930, being given the number 24,084/29. This patent dealt with a bag which used a rigid member to roll the open end portion of a bag over on itself towards the contents in the bag. A string or similar tie was placed along the rigid member. When the open end portion was suitably rolled up, the rigid member was withdrawn, and the ends of the string were tied together to hold the rolled up portion in place. This bag would not be suitable for use as a typical snack type bag, to which this patent is directed.

A further foreign patent was issued in Sweden in 1944, given the number 111 307. This patent used a strip that was used to assist in rolling up the open ends of a bag, and the ends of the strip were connected together, which aided in holding the rolled up portion of the bag in a rolled up configuration.

In addition to the above patents, The Republic of Germany (West Germany), issued Patent Number 1536339 in 1970. This patent had similarities to the Patent of 1908 from the United Kingdom mentioned above, but the resilient strip was affixed to one of the end flaps, which was able to fold over the opposing end flap, and then be used to roll up both flaps toward the contents of the bag. Once rolled up, the ends of the strip were joined. These inventions fall short of the ease of use and optimal sealing that the invention described below describes, and required the use of end flaps.

SUMMARY OF THE INVENTION

It is the object of this invention to supply an improved bag, having an improved means to completely reseal the bag, when the bag is used for the storage of other items. The bag can be resealed by folding over a top edge, and rolling the body of the bag in a direction opposite the folding, so that an airtight, or nearly airtight seal is achieved, to protect against leakage or contamination.

It is a further object of this invention to supply an improved bag, having a means to completely reseal the bag, so as to provide an internal pressurized air buffer to protect the contents inside the bag from damaging external forces.

It is a further object of this invention to provide an improved bag, having a means that allows the bag to be resealed, so that a strong airtight seal is created, using the bag designs currently in use, with the means to reseal the bag comprising an adaptation or accessory that can be added to existing bag designs, comprising a snap or any type of fastener, to be placed on the front or back along the right and left edges.

In order to take full advantage of the use of this improved bag, the initial act of opening the end of the bag must be done so that the sides of the bag do not tear or rip significantly along the length of the bag. Rips or tears that extend from the open end, past the location of a line that extends across the bag and intersects both of the snaps, can diminish the ability to properly reseal the bag.

After the bag has been opened, it may be resealed by folding over a top edge of the bag, and then holding the bag side edges with both hands at the point of the snaps, and then rolling the bag in a direction opposite the fold, by flipping or swinging the bag over once or twice to form a roll of the bag material. The rolling of the bag starts near the fold and progresses downwards. This process of rolling has a two fold purpose. The first purpose is to compress the fold against itself to help trap the air in the bag and moves it downwards within the bag to inflate the bag. The second purpose is to decrease the overall internal area within the bag, without allowing any air to escape, thus giving the bag an inflated appearance which further protects the contents.

The rolled portion creates a convoluted path that air must travel through to enter or exit the bag. A convoluted air path by itself does not necessarily provide a strong airtight seal however, unless the layers of the rolled portion are pressed tightly together. It is difficult to achieve the requisite amount of force necessary to urge the rolled portion layers together into an airtight seal, simply by firmly rolling the bag end flaps. If a clip is used, it is a separate item that must be located and found before it can be fastened over the rolled portion, to squeeze the rolled portion, the clip must apply the requisite force over the entire area of the rolled portion, or else an airtight seal will not be achieved. This invention is an improvement over this type of method, since the attachment and sealing means is located directly on the bag, so that the user does not need to locate separate clips.

An airtight seal is achieved when the rolled portion is bent and curved into a U-shape by urging the ends of the rolled portion together, and fastening them together using snaps. When the rolled portion ends are urged together, the layers of the rolled portion fold over on themselves, pressing tightly against each other, and providing a squeezing force against the fold. This completely closes off the various convoluted air passages within the rolled portion and fold, and provides a virtually airtight seal.

The position of the snaps on the bag, are preferably located on the front or back of the bag, near the left and right edges. To reseal the bag, the bag is folded and rolled, so that the rolled portion itself defines ideally at least a full 360 degree circle. In addition, since the connection points of the preferably positioned snaps on the sides of the bag are actually a small distance from the side edges of the bag, the entire top part of the bag, comprising the rolled portion, and the adjacent portion of the bag not rolled, are squeezed when the snaps are properly attached together. This is an improved seal over the prior art, which uses strictly protruding tabs or attachment means.

When a bag is resealed in this manner, it will maintain a constant pressurized seal that maintains the freshness of the contents, and protects them from external blows that would otherwise damage them. To reopen the bag, the snaps are disconnected, and the rolled portion is unrolled to expose the mouth of the bag. This method of resealing and reopening can be done numerous times on a single bag, achieving an airtight seal every time.

DESCRIPTION OF THE PREFERRED EMBODIMENT

Figure 1:
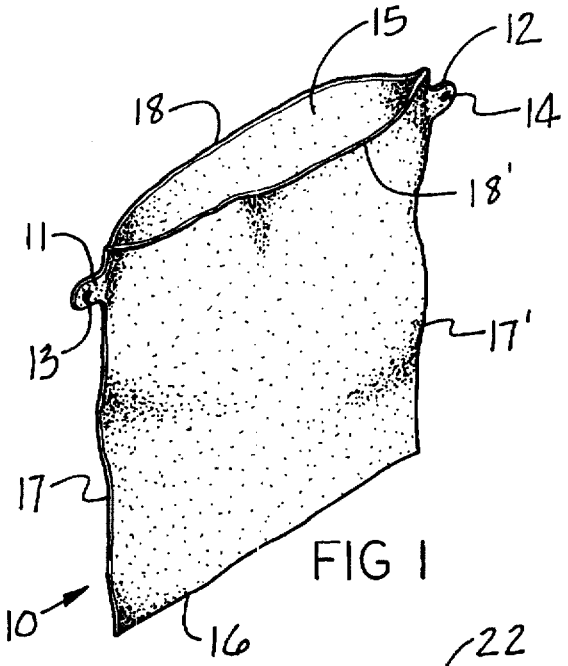
FIG. 1 depicts a perspective view of a bag, viewed from the front side.

As shown in FIG. 1, a bag 10 embodying the invention comprises a bag 10 having a generally rectangular appearance from a frontal view, with bag 10 being provided with a set of snaps 20, that are located on a front side 11 of the bag 10. The bag 10 may be made from a front sheet 11 and a back sheet 12, where each sheet is defined by a top edge 13, generally parallel side edges 15, and a bottom edge 14. Sheets 11 and 12 are placed adjacent to each other, and joined together along their respective edges 13, 14 and 15 to create a sealed inner area. Bag 10 may also be made from a tubular stock, that can be flattened and folded to create a desired rectangular shape, with snaps 20 and 21 located near the top edge 13 as shown in FIG. 1. With a tubular stock bag 10, a sealed bottom is formed by flattening the tubular portion, and sealing the bottom edges 14 together.

Bag 10 is usually intended to provide a container, having airtight capability prior to it's being opened. A volume of air is usually allowed or injected into the bag 10 with the contents, prior to its first sealing, so that when bag 10 is sealed, as shown in FIG. 1, the contents will be protected from external forces, by the cushion of air that pressurizes the bag 10.

Figure 2:
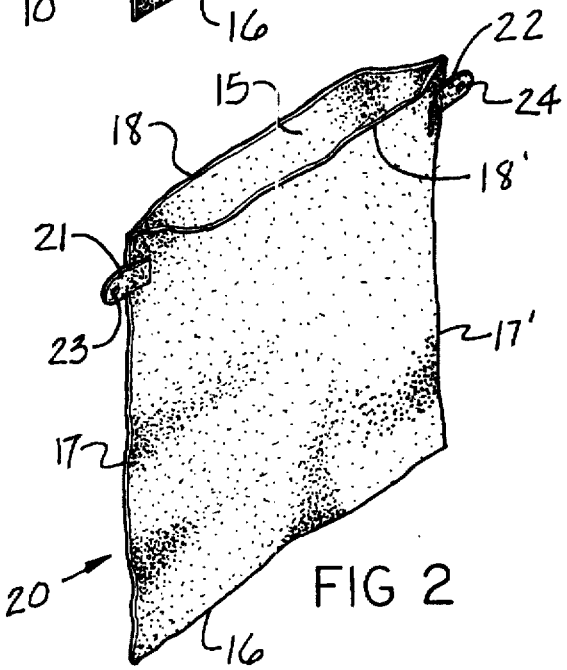
FIG. 2 depicts a perspective view of a bag having an open end, with a set of snaps visible on the front of the bag.

Referring also to FIG. 2, when access to the contents is desired, bag 10 is opened by separating the top edges 13 of the front sheet 11 and back sheet 12, to form a mouth 17 which reveals the contents of the bag 10. It is important to the operation of this invention that the top edges 13 be separated so that there are no substantial tears from the top edge 13 down either the front sheet 11 or back sheet 12 toward the bottom edge 14. While a tear may occur, its progression toward the bottom edge 14 should not extend past the snaps 20 and 21.

The front side 11 has a set of snaps 20 and 21 attached directly to it, with said snaps 20 and 21 being of design common in the art, and operated by pressing said snaps 20 and 21 together so that they grip each other. Where a tubular stock is used, the bottom edges are sealed together, with the top edge defining a mouth. The tubular stock may be flattened into the same shape and construction as bag 10 depicted in FIG. 2.

The snaps 20 and 21 are separated by pulling them apart from each other. These snaps 20 and 21 are of construction and design common in the industry, and may be formed out of plastic, or any fairly rigid substance. Preferably, a plastic polymer is used for the combination of light weight and sufficient strength for the purposes required by bag 10.

Snap 20 and 21 are positioned downward on the front side 11, along the length of the bag 10, and adjacent to the side edges 15 along a line 5 generally parallel to the top edge 13, and which intersects snap 20 and 21. Snaps 20 and 21 are located along line 5 which is closer to the top edge 13 than the bottom edge 14. In order for this invention to operate properly, the snaps 20 and 21 must be located at least one-half inch from the top edge 13. Snap 20 is oriented in the same position as snap 21, so that both snaps 20 and 21 protrude outward from the front sheet 11 in the same manner.

Figure 3:
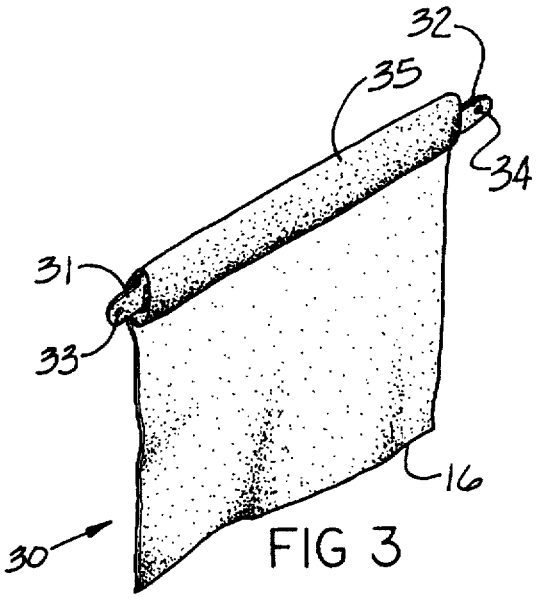
FIG. 3 depicts a perspective view of a bag, from the upper front side of the bag, in which the top portion has been folded over toward the back side of the bag, with the snaps located on the front of the bag near the fold.

When the bag 10 is put to use, and has been opened so that contents remain within the bag 10, or the user simply wishes to reseal the bag 10, it is able to be resealed using this improved closure system and method. The top edges 13 are pressed together along their length, and then a first fold is made so that the top edges 13 are folded over from the front to the back, as shown in FIG. 3. The fold should be made so that the top portion of the bag that is folded over is pressed firmly against the back side 12. The first fold is made across bag 10, with the first fold located in between the top edges 13 and the line 5 that intersects snaps 20 and 2 1. The snaps 20 and 21 remain on the front side 11 after the first fold, with the snaps 20 and 21 immediately adjacent to the first fold.

Figure 4:
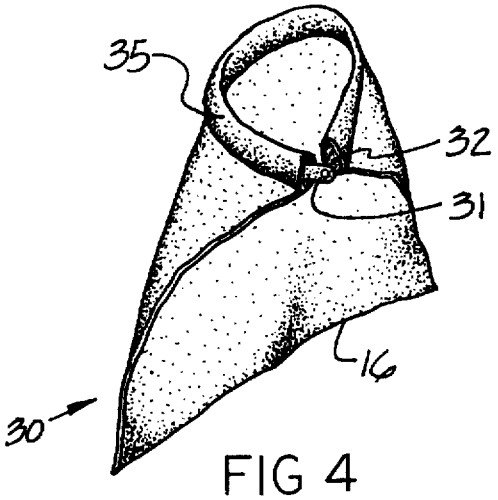
FIG. 4 is a perspective view of a bag, with the set of snaps shown as they would be positioned on the visible side of the bag, after the top portion of the bag has been rolled around the folded portion.

Referring also to FIG. 4, following the establishment of the first fold, the top of bag 10 is then rolled in the same direction as the top portion has been folded, being from the front side 11 to the back side 12. Preferably, the user will grasp and hold snap 20 with the left hand, and snap 21 with the right hand, and swing the bag 10 so that the bottom side 14 rotates upward and backwards around the snaps 20 and 21 and the intersecting line 5. The rotational movement of the bag 10, in relation to the snaps 20 and 21 and line 5, continues in the direction opposite to that which the fold was made, until the body of the bag 10 and bottom side have rotated 360 degrees.

As the body of bag 10 moves over and above the snaps 20 and 21 that are intersected by line 5, and then forward and downwards to a vertically hanging position, back sheet 12 will engage the top edge 13 and fold, and provide a squeezing force against the fold which further restricts the ability of air to move in or out of bag 10.

During the rotational flipping of the bag 10, the sides edges 15 will be forced inwards toward each other slightly, due to the rotational motion and as they encounter the resistance of the user's gripping hands and wrists during the last 180 degrees of the rotation. Once the bottom edge 14 has rotated approximately 360 degrees, so that the bottom edge 14 is hanging directly downwards, snaps 20 and 21 and the rolled portion of the bag 10 to which they are attached, should extend outward from the side edges 15. The user's hands or fingers should be able to remain grasping snaps 20 and 21 unhindered by the side edges 15.

Figure 5:
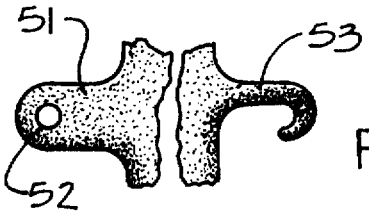
FIG. 5 depicts a perspective view of a bag, in which the ends of the rolled portion have been urged together, so that the rolled portion forms a U-shape, and where the snaps on the folded portion have been attached to each other.
Figure 6:
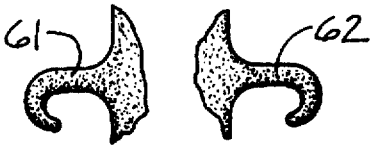
FIG. 6 is a perspective view of the snaps and rolled portion, with the snaps attached to each other.
Figure 7:
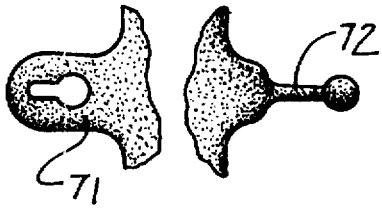

Referring also to FIGS. 5 and 6, to fully seal bag 10, the rolled portion is bent and curved into a U-shape, so that snaps 20 and 21 are able to attach to each other, retaining closure until the bag 10 is desired to be reopened. With this arrangement, when the rolled portion is manipulated into the curved rolled portion, the rolled portion presses the top edge 13 and first fold against the back sheet 12, providing an even stronger seal.

When it is desired to unseal the bag 10, the snap 20 is simply detached from snap 21, allowing the rolled portion to straighten out so it can be unrolled, releasing the squeezing pressure against the fold. The top edges 13 can then be separated to form the mouth 17, allowing access to any contents. This bag 10 may be reopened and resealed as often as necessary, without significant loss of sealing ability.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. An improved closure system and method for resealing a bag, having a set of snaps attached thereto, comprising the steps of:

(a) pressing the top edges of a bag together along their length;

(b) making a first fold across the bag, so that the top edges are folded over from the front to the back, with the first fold located in between the top edges and a line that intersects the snaps, which remain on the front side of the bag after the first fold, and having the fold press firmly against the back side of the bag;

(c) rolling the top of the bag in the same direction as the top portion has been folded, being from the front side of the bag to the back side of said bag, so that the bottom side rotates upward and backwards around the snaps and the intersecting line, with the movement of the bag continuing in a direction opposite to that which the fold was made, until the body of the bag and bottom side have rotated 360 degrees;

(d) Attaching the snaps to each other, to provide a squeezing force against the fold which further restricts the ability of air to move in or out of bag.

* * * * *